US006441750B1

(12) United States Patent
Hutchison

(10) Patent No.: US 6,441,750 B1
(45) Date of Patent: Aug. 27, 2002

(54) LIGHT ALIGNMENT SYSTEM FOR ELECTRONICALLY STEERABLE LIGHT OUTPUT IN TRAFFIC SIGNALS

(75) Inventor: Michael C. Hutchison, Plano, TX (US)

(73) Assignee: Power Signal Technologies Inc., Plano, TX (US)

( * ) Notice: Subject to any disclaimer, the term of this patent is extended or adjusted under 35 U.S.C. 154(b) by 0 days.

(21) Appl. No.: 09/643,692

(22) Filed: Aug. 22, 2000

(51) Int. Cl.[7] ..... G08G 1/095

(52) U.S. Cl. ..... 340/907; 340/815.4; 340/815.45; 340/815.5; 340/908; 356/FOR 125; 362/245

(58) Field of Search ..... 340/907, 908, 340/906, 916, 815.4, 815.43, 815.45, 815.5, 908.1; 362/245, 249, 226, 250, 269, 290, 359; 356/FOR 125

(56) References Cited

U.S. PATENT DOCUMENTS

| | | | | |
|---|---|---|---|---|
| 3,576,563 A | * | 4/1971 | Scott et al. | |
| 4,450,507 A | * | 5/1984 | Gordin | 362/249 |
| 4,659,046 A | * | 4/1987 | Parduhn | 248/231 |
| 5,589,901 A | * | 12/1996 | Means | 396/12 |
| 5,695,346 A | | 12/1997 | Sekiguchi et al. | |
| 5,805,081 A | * | 9/1998 | Fikacek | 340/908 |
| 5,806,969 A | | 9/1998 | Rosengren | |
| 5,850,126 A | | 12/1998 | Kanbar | |
| 5,947,587 A | | 9/1999 | Keuper et al. | |
| 6,057,814 A | | 5/2000 | Kalt | |
| 6,058,634 A | | 5/2000 | McSpiritt | |
| 6,092,318 A | | 7/2000 | Arie et al. | |
| 6,195,016 B1 | | 2/2001 | Shankle et al. | |
| 6,283,613 B1 | * | 9/2001 | Schaffer | 362/245 |

FOREIGN PATENT DOCUMENTS

| | | |
|---|---|---|
| DE | 40 42 258 A1 | 9/1991 |
| DE | 298 24 078 | 4/2000 |
| DE | 200 08 886 | 12/2000 |
| EP | 0 935 145 A1 | 8/1999 |
| EP | 0 955 623 A2 | 11/1999 |
| JP | 411261990 A | 3/1998 |

* cited by examiner

*Primary Examiner*—Brent A. Swarthout
(74) *Attorney, Agent, or Firm*—Jackson Walker LLP

(57) ABSTRACT

A solid state traffic control signal adapted to facilitate light alignment and viewing angles during installation. The traffic control signal includes a video camera or a detachable optical sighting system with a grid representing the various viewing angles of individual LED's for quick alignment and viewing angle programming. This system greatly reduces the amount of trial-and-error and multi-man requirements for installation.

20 Claims, 16 Drawing Sheets

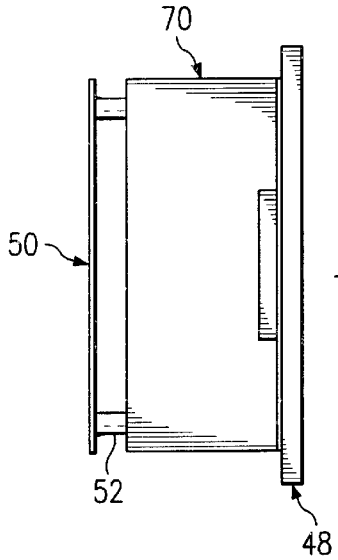
FIG. 7
FIG. 8
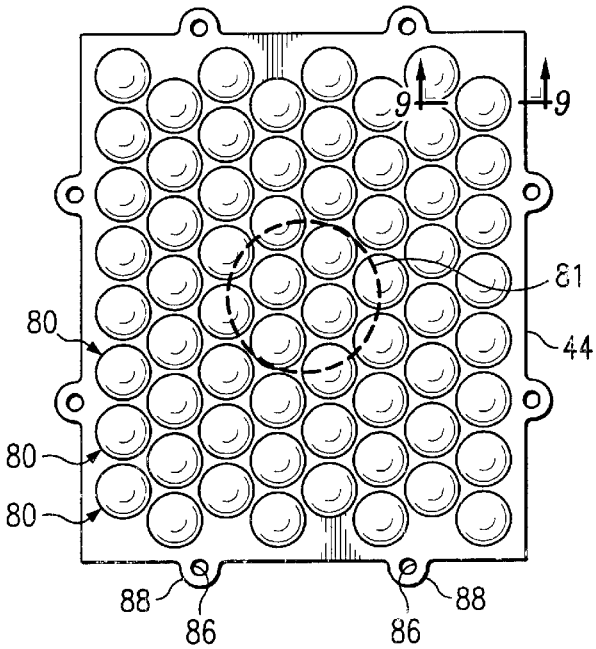
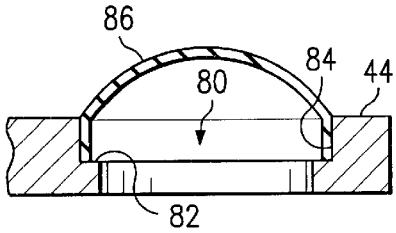
FIG. 9

FIG. 10
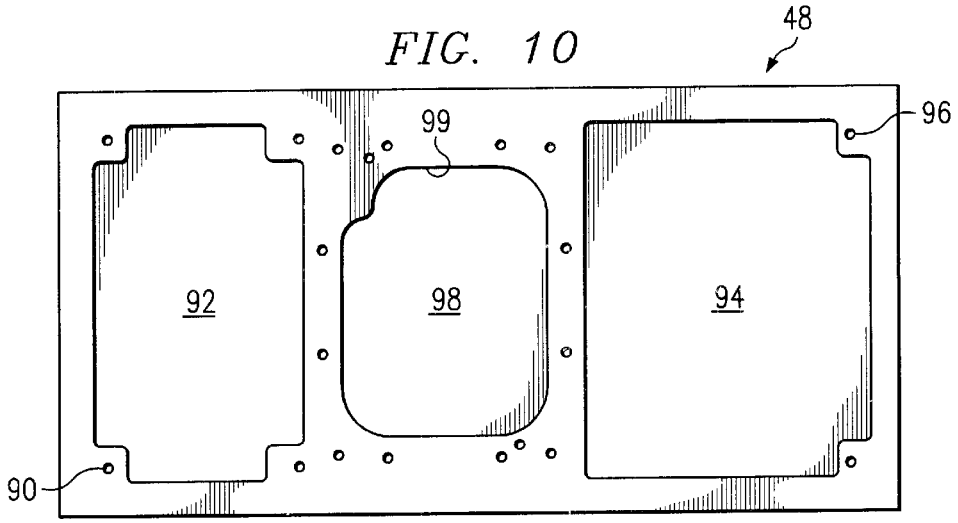
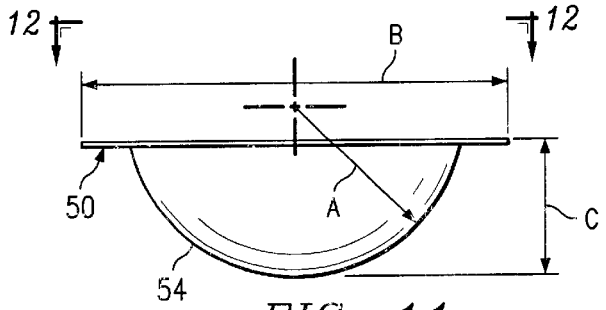
FIG. 11
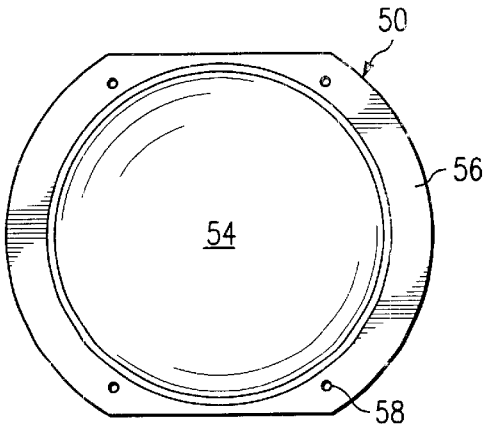
FIG. 12
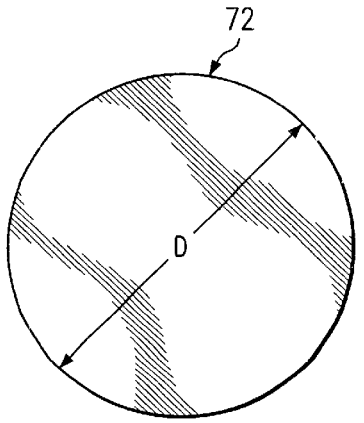
FIG. 13

TO FIG. 16C

U1
J2
100
+3.3V
GNDIO
VCCIO
VCCINT
GNDINT
GCLK1
OE1
GCLRN
OE2/GCLK2
TDI/IO
TDO/IO
IO
TO FIG. 16E
FROM FIG. 16A

100
J1
10
9
8
7
6
5
4
3
2
1
+3.3V
R5
R7
112
+7V
R2
R1
C1
U9
110
+4.85
R9
R8
R10
C5
U6
120
LED PWM
R12
C6
C10
PD1
R11
Q1
U7
TDO
UPDN2
TO FIG. 16F
FROM FIG. 16B

LIGHT ALIGNMENT SYSTEM FOR ELECTRONICALLY STEERABLE LIGHT OUTPUT IN TRAFFIC SIGNALS

CROSS REFERENCE TO RELATED APPLICATIONS

Cross reference is made to commonly assigned co-pending patent application Ser. No. 09/641,424, entitled "Solid State Traffic Light With Predictive Failure Mechanisms" filed Aug. 16, 2000, the teachings of which are incorporated herein by reference.

FIELD OF THE INVENTION

The present invention is generally related to light sources, and more particularly to the alignment of traffic signal lights including those incorporating both incandescent and solid state light sources.

BACKGROUND OF THE INVENTION

Traffic signal lights have been around for years and are used to efficiently control traffic through intersections. While traffic signals have been around for years, improvements continue to be made in the areas of traffic signal light control algorithms, traffic volume detection, and emergency vehicle detection.

There continues to be a need to be able to predict when a traffic signal light source will fail. The safety issues of an unreliable traffic signal are obvious. The primary failure mechanism of an incandescent light source is an abrupt termination of the light output caused by filament breakage. The primary failure mechanism of a solid state light source is gradual decreasing of light output over time, and then ultimately, no light output.

The current state of the art for solid state light sources is as direct replacements for incandescent light sources. The life time of traditional solid state light sources is far longer than incandescent light sources, currently having a useful operational life of 10–100 times that of traditional incandescent light sources. This additional life time helps compensate for the additional cost associated with solid state light sources.

However, solid state light sources are still traditionally used in the same way as incandescent light sources, that is, continuing to operate the solid state light source until the light output is insufficient or non existent, and then replacing the light source. The light output is traditionally measured by a person with a light meter, measuring the light output from the solid state light source from a Department of Transportation (DOT) "bucket".

Other problems with traditional traffic signal light sources is the intense heat generated by the light source. In particular, temperature greatly affects the life time of solid state light sources. If the temperature can be reduced, the operational life of the solid state light source may increase between 3 fold and 10 fold. Traditionally, solid state light sources today are designed as individual light emitting diodes (LEDs) individually mounted to a printed circuit board (PCB), and placed in a protective enclosure. This protective enclosure produces a large amount of heat and has severe heat dissipation problems, thereby reducing the life of the solid state light source dramatically.

In addition to temperature, oxidation also greatly effects the lifetime of solid state light sources. For instance, when oxygen is allowed to combine with aluminum on an aluminum gallium arsenide phosphorus (AlInGaP) LED, oxidation will occur and the light output is significantly reduced.

With specific regards to solid state light sources, typical solid state light sources comprised of LEDs are traditionally too bright early in their life, and yet not bright enough in their later stages of life. Traditional solid state light sources used in traffic control signals are traditionally over driven initially so that when the light reduces later, the light output is still at a proper level meeting DOT requirements. However, this overdrive significantly reduces the life of the LED device due to the increased, and unnecessary, drive power and associated heat of the device during the early term of use. Thus, not only is the cost for operating the signal increased, but more importantly, the overall life of the device is significantly reduced by overdriving the solid state light source during the initial term of operation.

Still another problem with traditional light sources for traffic signals is detection of the light output using the traditional hand held meter. Ambient light greatly affects the accurate detection of light output from the light source. Therefore, it has been difficult in the past to precisely set the light output to a level that meets DOT standards, but which light source is not over driven to the point of providing more light than necessary, which as previously mentioned, increases temperature and degrades the useful life of the solid state device.

Still another problem in prior art traffic signals is that signal visibility needs to be controlled so only specific lanes of traffic are able to see the traffic light. An example is when a left turn lane has a green light, and an adjacent lane is designated as a straight lane. It is necessary for traffic in the left turn lane to see the green light. The current visibility control mechanism is mechanical, typically implementing a set of baffles inserted into the light system to carefully point the light in the left lane in the correct direction. The mechanical direction system is not very controllable because it is controlled in only one dimension, typically either up or down, or, either right or left, but not both. Consequently, the light is undesirable often seen in the adjacent lane. There is arisen a need for a better method to control the visibility range of a traffic signal.

Traditionally, old technology is typically replaced with new technology by simply disposing of the old technology traffic devices. Since most cities don't have the budget to replace all traffic control devices when new ones come to market, they have traditionally taken the position of replacing only a portion of the cities devices at any given time, thereby increasing the inventory needed for the city. Larger cities end up inventorying between four and five different manufacture's traffic signals, some of which are not in production any longer. The added cost is not only for storage of inventoried items, but also the overhead of taking all different types of equipment to a repair site, or cataloging the different inventoried items at different locations.

With respect to alignment systems for traffic lights, traditionally alignment traffic control devices provide that one person points the generated light beam in the desired direction from a bucket while above the intersection, while another person stands in the traffic lanes to determine if the light is aligned properly. The person on the ground has to move over the entire field of view to check the light alignment. If the light is masked off (such as a turn arrow), there are more alignment iterations. There is desired a faster and more reliable method of aligning traffic signals.

Traffic lights also have a problem during darker conditions, i.e. at night or at dusk when the light is not well defined. This causes a problem if the light has to be masked off for any reason, whereby light may overlap to areas that should be off. This imprecise on/off boundary is called "ghosting". There is a need to find an improved way to define is the light/dark boundary of the traffic light to reduce ghosting. The ghosting is primarily caused by the angle the light hits on the "risers" on a Fresnel lens. A traffic light with a longer focal length reduces the angle, therefore decreasing the amount of ghosting. Therefore, devices with shorter focal lengths have increased ghosting. Another cause of ghosting is stray light from arrays of LED lights. Typical LED designs have a rather large intensity peek, that is, a less uniform beam of light being generated from the array.

SUMMARY OF THE INVENTION

The present invention achieves many technical advantages as an improved traffic control signal facilitating the accurate alignment of a light beam generated by an array of LED devices. The traffic control light includes an integral optical sighting system and/or a video camera generating an image aligned with individual LEDs therein.

A solid state light source has many advantageous features including the ability to predict failure of the light source, as well as an extended life time by using a heatsink to sink heat away from an LED light array, hermetically sealing the array of LEDs, and controlling the light output over time to prevent overdrive of the LED array. Other features of the present invention include providing a constant output of light from a solid state light source by providing optical feedback of light and electronic filtering to accurately detect and discern generated light from ambient light.

Other advantages of the solid state light source include an electronically steerable light beam having the ability to steer light into two dimensions, insuring only the intended lane of traffic is able to visually perceive the beam of light. In addition, the solid state light source is modularly upgradeable to allow upgrades of existing components, and the adaption of new components to keep the traffic signal state of the art. An optical sight alignment mechanism is also provided with the light source allowing a technician at the light source to determine where a beam of light generated from the light array is directed, without requiring the assistance of an on ground technician. Yet another feature of the present invention is an opto-electronic ghosting control for a light source reducing ghosting of a generated beam of light.

The solid state light of the present invention includes several new features, and several improved features, providing a state of the art solid state light source that overcomes the limitations of prior art traffic sources, including those with conventional solid state light sources.

BRIEF DESCRIPTION OF THE DRAWINGS

FIG. 7 is a side view of the electronics assembly of FIG. 4;

FIG. 8 is a top view of the lens holder adapted to hold lenses for the array of LEDs;

FIG. 9 is a sectional view taken alone lines 9—9 in FIG. 8 illustrating a shoulder and side wall adapted to securely receive a respective lens for a LED mounted thereunder;

FIG. 10 is a top view of the heatsink comprised of a thermally conductive material and adapted to securingly receive each LED, the LED holder of FIG. 8, as well as the other componentry;

FIG. 11 is a side view of the light diffuser depicting its radius of curvature;

FIG. 12 is a top view of the light diffuser of FIG. 11 illustrating the mounting flanges thereof;

FIG. 13 is a top view of a Fresnel lens as shown in FIG. 3;

DETAILED DESCRIPTION OF PREFERRED EMBODIMENTS

Figure 1B:
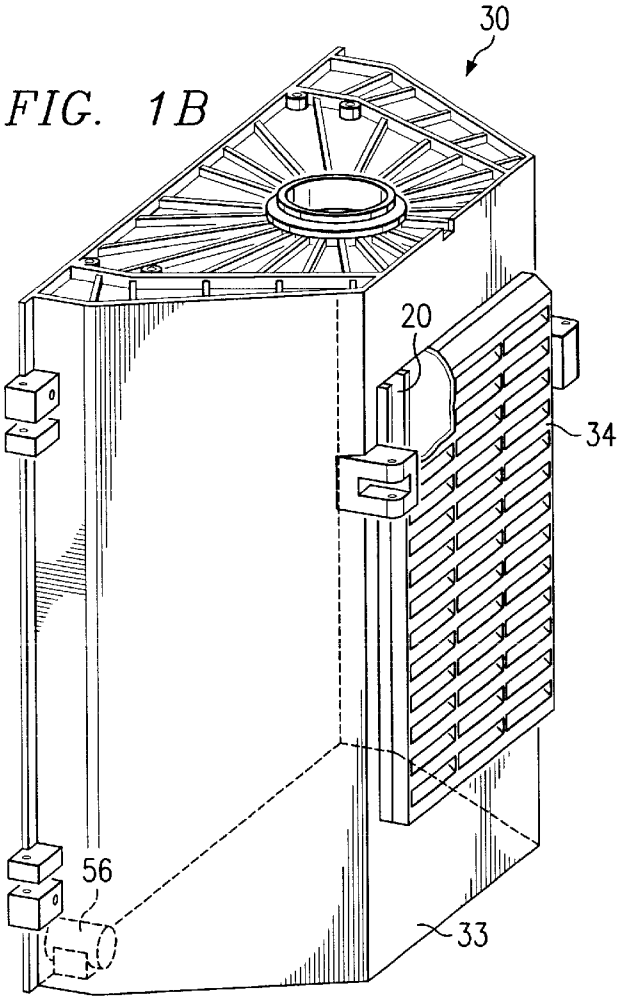
FIG. 1A and FIG. 1B is a front perspective view and rear perspective view, respectively, of a solid state light apparatus according to a first preferred embodiment of the present invention including an optical alignment eye piece.
Figure 1A:
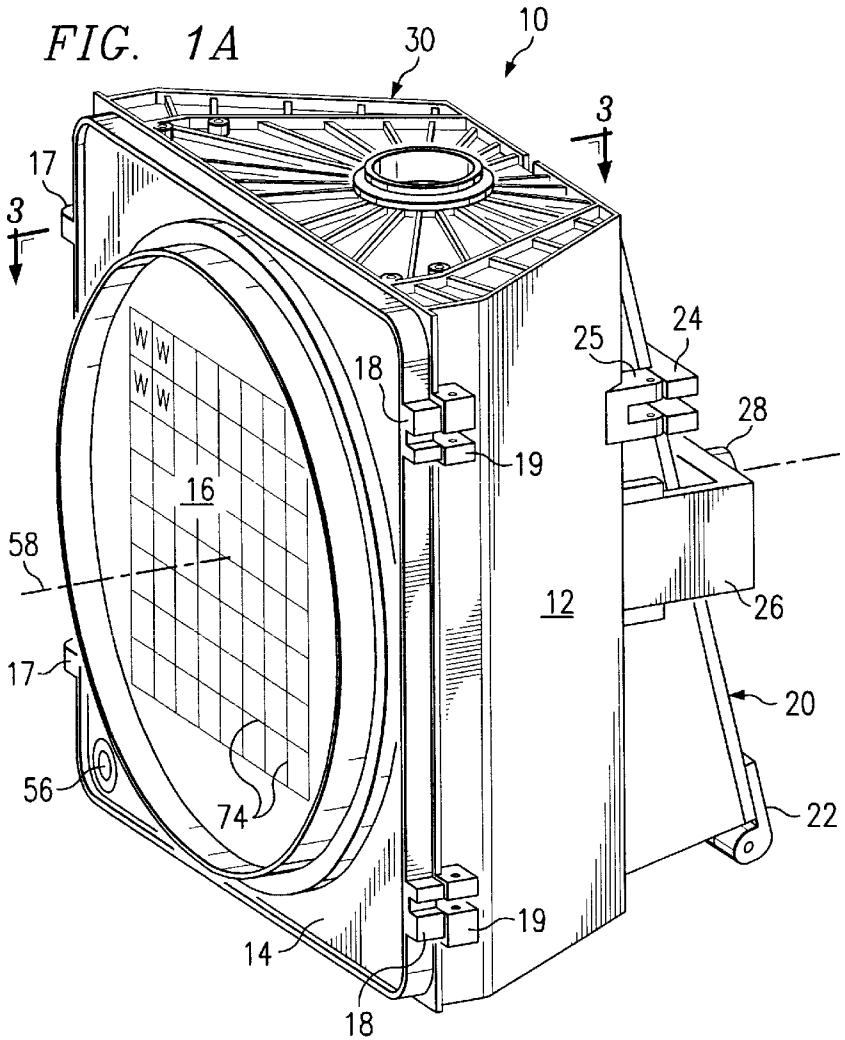

Referring now to FIG. 1A, there is illustrated generally at 10 a front perspective view of a solid state lamp apparatus according to a first preferred embodiment of the present invention. Light apparatus 10 is seen to comprise a trapezoidal shaped housing 12, preferably comprised of plastic formed by a plastic molding injection techniques, and having adapted to the front thereof a pivoting lid 14. Lid 14 is seen to have a window 16, as will be discussed shortly, permitting light generated from within housing 12 to be emitted as a light beam therethrough. Lid 14 is selectively and securable attached to housing 12 via a hinge assemble 17 and secured via latch 18 which is juxtaposed with respect to a housing latch 19, as shown.

Figure 2B:
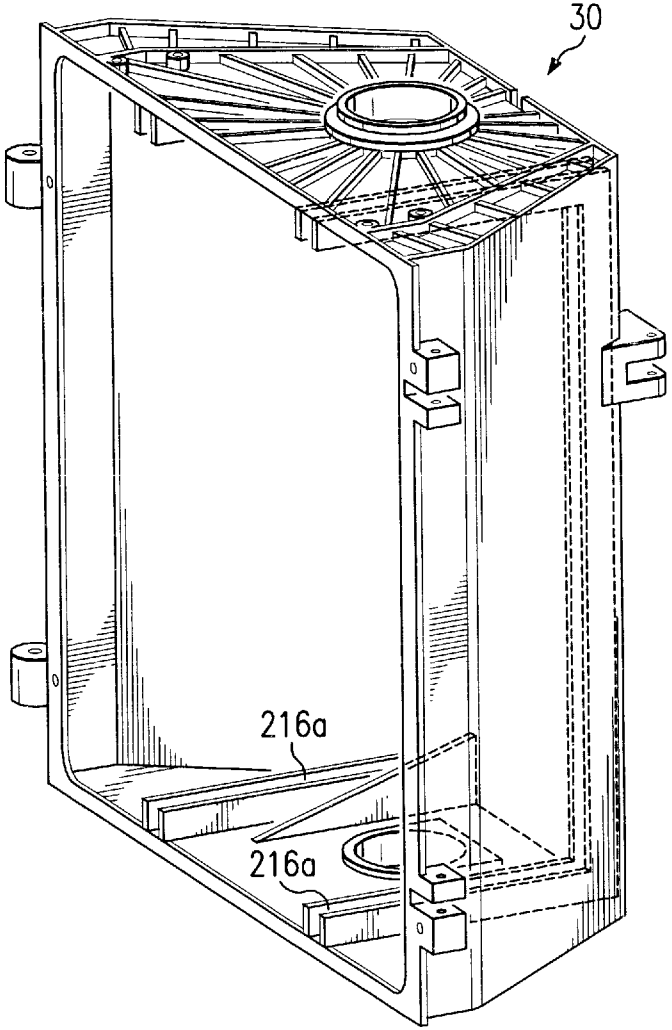
FIG. 2A and FIG. 2B is a front perspective view and a rear perspective view, respectively, of a second preferred embodiment having a solar louvered external air cooled heatsink.

Referring now to FIG. 1B and FIG. 2B, there is illustrated a second preferred embodiment of the present invention at 32 similar to apparatus 10, whereby a housing 33 includes a solar louver 34 as shown in FIG. 2B. The solar louver 34 is secured to housing 33 and disposed over a external heatsink 20 which shields the external heatsink 20 from solar radiation while permitting outside airflow across the heatsink 20 and under the shield 34, thereby significantly improving cooling efficiency as will be discussed more shortly.

Figure 2A:
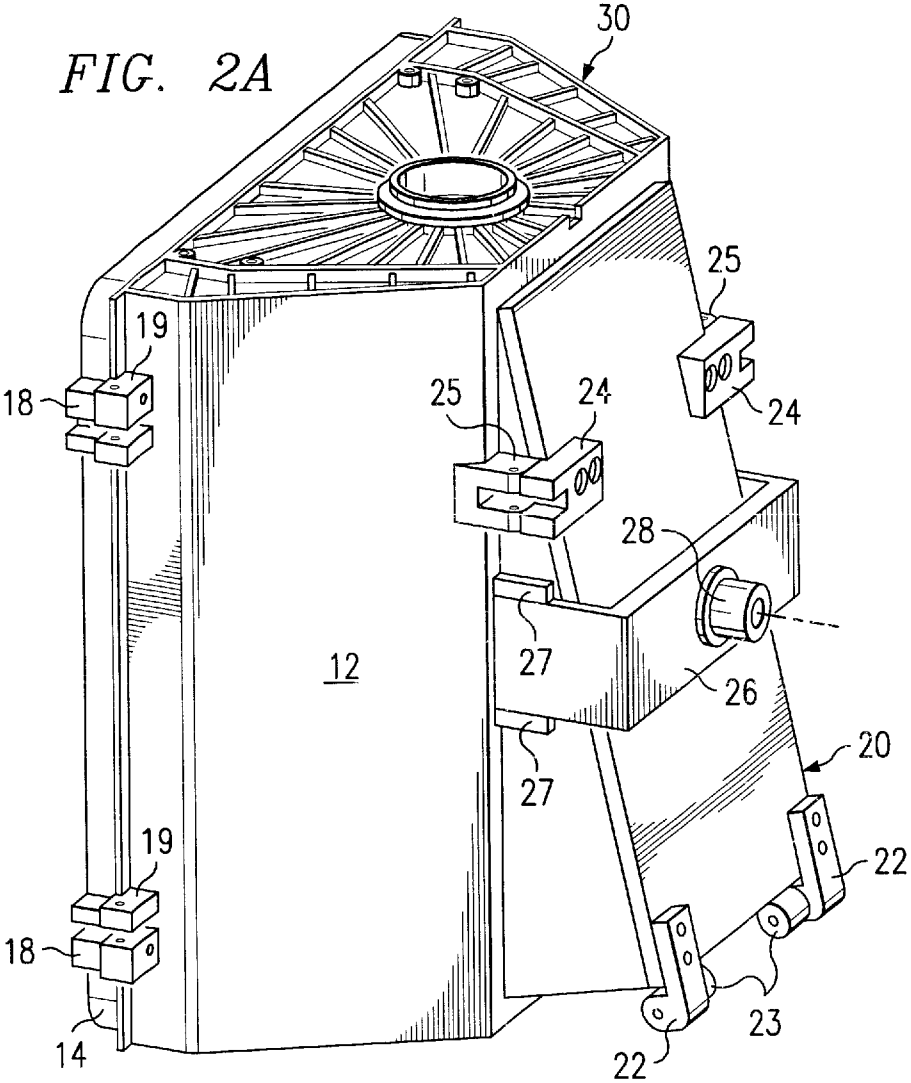

Referring to FIG. 2A, there is shown light apparatus 10 of FIG. 1A having a rear removable back member 20 comprised of thermally conductive material and forming a heatsink for radiating heat generated by the internal solid state light source, to be discussed shortly. Heatsink 20 is seen to have secured thereto a pair hinges 22 which are rotatably coupled to respective hinge members 23 which are securely attached and integral to the bottom of the housing 12, as shown. Heatsink 20 is further seen to include a pair of opposing upper latches 24 selectively securable to respective opposing latches 25 forming an integral portion of and secured to housing 12. By selectively disconnecting latches 24 from respective latches 25, the entire rear heatsink 20 may be pivoted about members 23 to access the internal portion of housing 12, as well as the light assembly secured to the front surface of heatsink 20, as will be discussed shortly in regards to FIG. 3.

Figure 3:
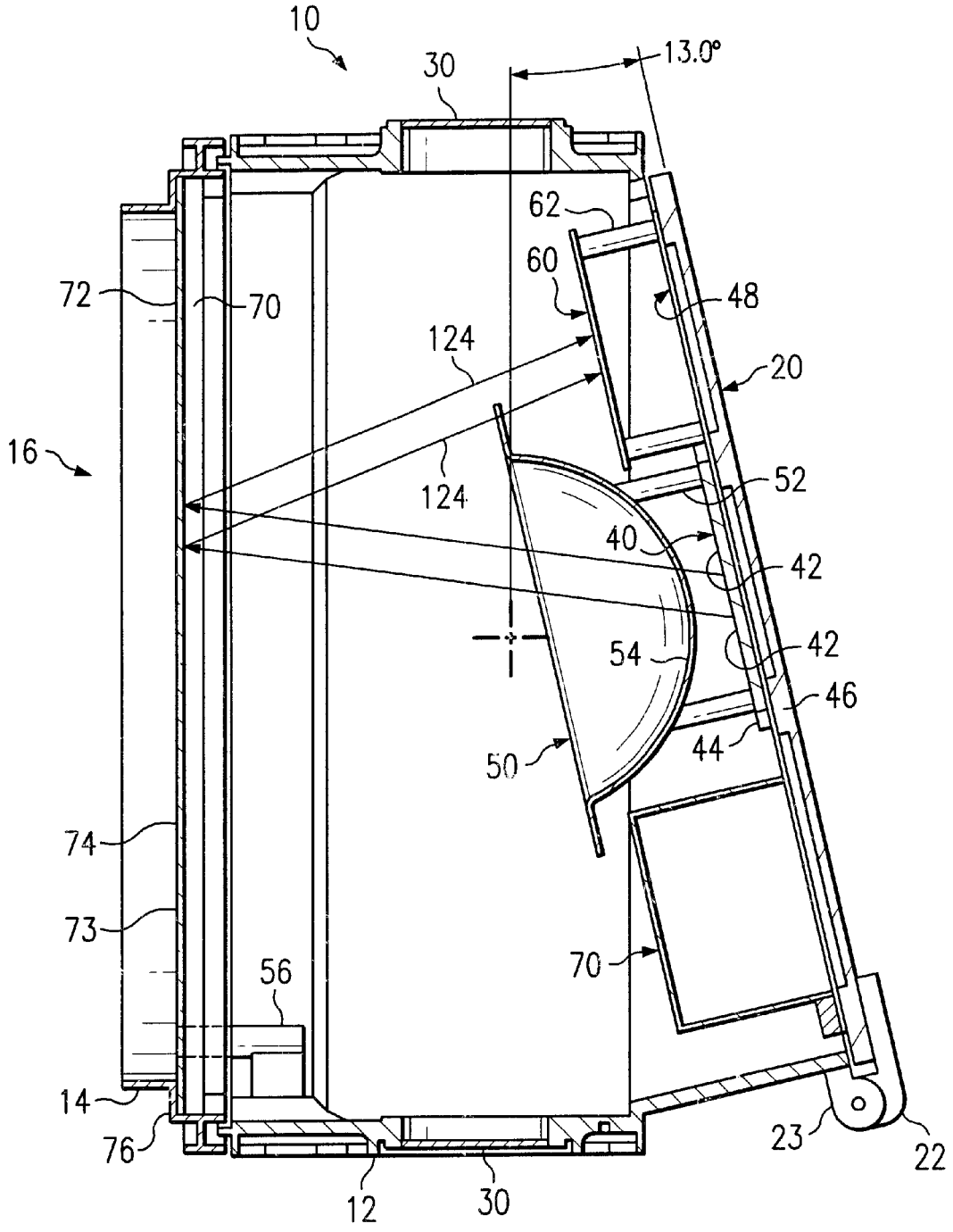
FIG. 3 is a side sectional view of the apparatus shown in FIG. 1 illustrating the electronic and optical assembly and lens system comprising an array of LEDs directly mounted to a heatsink, directing light through a diffuser and through a Fresnel lens.

Still referring to FIG. 2A, light apparatus 10 is further seen to include a rear eye piece 26 including a U-shaped bracket extending about heatsink 20 and secured to housing 12 by slidably locking into a pair of respective locking members 29 securely affixed to respective sidewalls of housing 12. Eye piece 26 is also seen to have a cylindrical optical sight member 28 formed at a central portion of, and extending rearward from, housing 12 to permit a user to optically view through apparatus 10 via optically aligned window 16 to determine the direction a light beam, and each LED, is directed, as will be described in more detail with reference to FIG. 14 and FIG. 15. Also shown is housing 12 having an upper opening 30 with a serrated collar centrally located within the top portion of housing 12, and opposing opening 30 at the lower end thereof, as shown in FIG. 3. Openings 30 facilitate securing apparatus 10 to a pair of vertical posts allowing rotation laterally thereabout.

Referring now to FIG. 3, there is shown a detailed cross sectional view taken along line 3—3 in FIG. 1, illustrating a solid state light assembly 40 secured to rear heatsink 20 in such an arrangement as to facilitate the transfer of heat generated by light assembly 40 to heatsink 20 for the dissipation of heat to the ambient via heatsink 20.

Solid state light assembly 40 is seen to comprise an array of light emitting diodes (LEDs) 42 aligned in a matrix, preferably comprising an 8×8 array of LEDs each capable of generating a light output of 1–3 lumens. However, limitation to the number of LEDs or the light output of each is not to be inferred. Each LED 42 is directly bonded to heatsink 20 within a respective light reflector comprising a recess defined therein. Each LED 42 is hermetically sealed by a glass material sealingly diffused at a low temperature over the LED die 42 and the wire bond thereto, such as 8000 Angstroms of, $SiO_2$ or $Si_3N_4$ material diffused using a semiconductor process. The technical advantages of this glass to metal hermetic seal over plastic/epoxy seals is significantly a longer LED life due to protecting the LED die from oxygen, humidity and other contaminants. If desired, for more light output, multiple LED dies 42 can be disposed in one reflector recess. Each LED 42 is directly secured to, and in thermal contact arrangement with, heatsink 20, whereby each LED is able to thermally dissipate heat via the bottom surface of the LED. Interfaced between the planar rear surface of each LED 42 is a thin layer of heat conductive material 46, such as a thin layer of epoxy or other suitable heat conductive material insuring that the entire rear surface of each LED 42 is in good thermal contact with rear heatsink 20 to efficiently thermally dissipate the heat generated by the LEDs. Each LED connected electrically in parallel has its cathode electrically coupled to the heatsink 20, and its Anode coupled to drive circuitry disposed on daughterboard 60. Alternatively, if each LED is electrically connected in series, the heatsink 20 preferably is comprised of an electrically non-conductive material such as ceramic.

Further shown in FIG. 3 is a main circuit board 48 secured to the front surface of heatsink 20, and having a central opening for allowing LED to pass generated light therethrough. LED holder 44 mates to the main circuit board 48 above and around the LED's 42, and supports a lens 86 above each LED. Also shown is a light diffuser 50 secured above the LEDs 42 by a plurality of standoffs 52, and having a rear curved surface 54 spaced from and disposed above the LED solid state light source 40, as shown. Each lens 86 (FIG. 9) is adapted to ensure each LED 42 generates light which impinges the rear surface 54 having the same surface area. Specifically, the lenses 86 at the center of the LED array have smaller radius of curvature than the lenses 86 covering the peripheral LEDs 42. The diffusing lenses 46 ensure each LED illuminates the same surface area of light diffuser 50, thereby providing a homogeneous (uniform) light beam of constant intensity.

A daughter circuit board 60 is secured to one end of heatsink 20 and main circuit board 48 by a plurality of standoffs 62, as shown. At the other end thereof is a power supply 70 secured to the main circuit board 48 and adapted to provide the required drive current and drive voltage to the LEDs 42 comprising solid state light source 40, as well as electronic circuitry disposed on daughterboard 60, as will be discussed shortly in regards to the schematic diagram shown in FIG. 16. Light diffuser 50 uniformly diffuses light generated from LEDs 42 of solid state light source 40 to produce a homogeneous light beam directed toward window 16.

Window 16 is seen to comprise a lens 70, and a Fresnel lens 72 in direct contact with lens 70 and interposed between lens 70 and the interior of housing 12 and facing light diffuser 50 and solid state light source 40. Lid 14 is seen to have a collar defining a shoulder 76 securely engaging and holding both of the round lens 70 and 72, as shown, and transparent sheet 73 having defined thereon grid 74 as will be discussed further shortly. One of the lenses 70 or 72 are colored to produce a desired color used to control traffic including green, yellow, red, white and orange.

It has been found that with the external heatsink being exposed to the outside air the outside heatsink 20 cools the LED die temperature up to 50° C. over a device not having a external heatsink. This is especially advantageous when the sun setting to the west late in the afternoon such as at an elevation of 10° or less, when the solar radiation directed in to the lenses and LEDs significantly increasing the operating temperature of the LED die for westerly facing signals. The external heatsink 20 prevents extreme internal operating air and die temperatures and prevents thermal runaway of the electronics therein.

Figure 4:
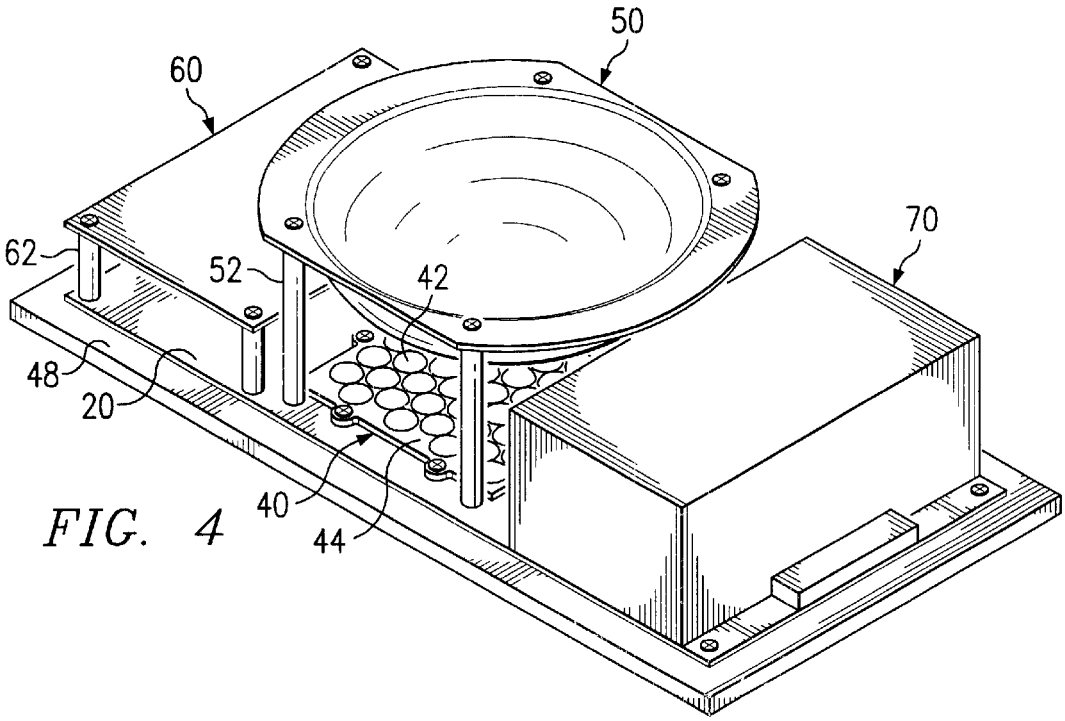
FIG. 4 is a perspective view of the electronic and optical assembly comprising the LED array, lense holder, light diffuser, power supply, main motherboard and daughterboard.

Referring now to FIG. 4, there is shown the electronic and optic assembly comprising of solid state light source 40, light diffuser 50, main circuit board 48, daughter board 60, and power supply 70. As illustrated, the electronic circuitry on daughter board 60 is elevated above the main board 48, whereby standoffs 62 are comprised of thermally nonconductive material.

Figure 5:
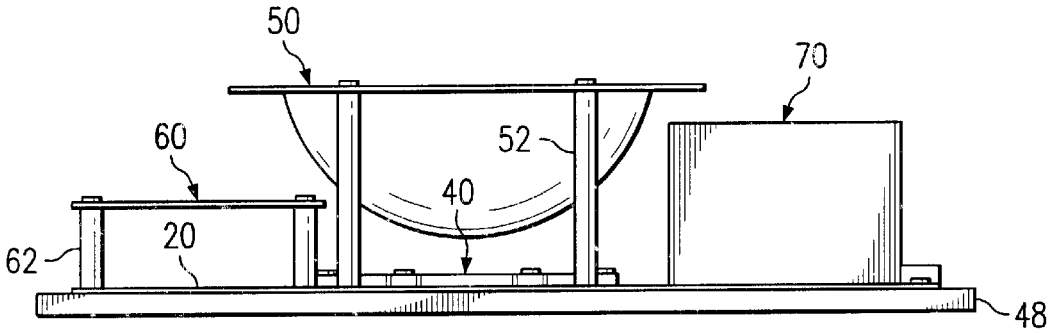
FIG. 5 is a side view of the assembly of FIG. 4 illustrating the array of LEDs being directly mounted to the heatsink, below respective lenses and disposed beneath a light diffuser, the heatsink for terminally dissipating generated heat.

Referring to FIG. 5, there is shown a side view of the assembly of FIG. 4 illustrating the light diffuser 50 being axially centered and disposed above the solid state LED array 40. Diffuser 50, in combination with the varying diameter lenses 86, facilitates light generated from the LEDs 42 to be uniformly disbursed and have uniform intensity and directed upwardly as a light beam toward the lens 70 and 72, as shown in FIG. 3.

Figure 6:
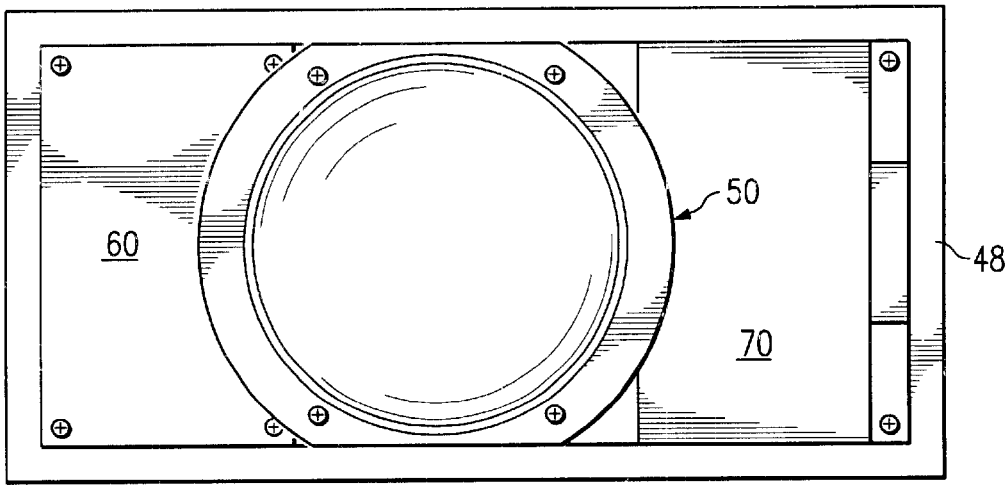
FIG. 6 is a top view of the electronics assembly of FIG. 4.

Referring now to FIG. 6, there is shown a top view of the assembly shown in FIG. 4, whereby FIG. 7 illustrates a side view of the same.

Referring now to FIG. 8, there is shown a top view of the lens holder 44 comprising a plurality of openings 80 each adapted to receive one of the LED lenses 86 hermetically sealed to and bonded thereover. Advantageously, the glass to metal hermetic seal has been found in this solid state light application to provide excellent thermal conductivity and hermetic sealing characteristics. Each opening 80 is shown to be defined in a tight pack arrangement about the plurality of LEDs 42. As previously mentioned, the lenses 86 at the center of the array, shown at 81, have a smaller curvature diameter than the lenses 86 over the perimeter LEDs 42 to increase light dispersion and ensure uniform light intensity impinging diffuser 50.

Referring to FIG. 9, there is shown a cross section taken alone line 9—9 in FIG. 8 illustrating each opening 80 having an annular shoulder 82 and a lateral sidewall 84 defined so that each cylindrical lens 86 is securely disposed within opening 80 above a respective LED 42. Each LED 42 is preferably mounted to heatsink 20 using a thermally conductive adhesive material such as epoxy to ensure there is no air gaps between the LED 42 and the heatsink 20. The present invention derives technical advantages by facilitating the efficient transfer of heat from LED 42 to the heatsink 20.

Referring now to FIG. 10, there is shown a top view of the main circuit board 48 having a plurality of openings 90 facilitating the attachment of standoffs 62 securing the daughter board above an end region 92. The power supply 48 is adapted to be secured above region 94 and secured via fasteners disposed through respective openings 96 at each comer thereof. Center region 98 is adapted to receive and have secured thereagainst in a thermal conductive relationship the LED holder 42 with the thermally conductive material 46 being disposed thereupon. The thermally conductive material preferably comprises of epoxy, having dimensions of, for instance, 0.05 inches. A large opening 99 facilitates the attachment of LED's 42 to the heatsink 20, and such that light from the LEDs 42 is directed to the light diffuser 50.

Referring now to FIG. 11, there is shown a side elevational view of diffuser 50 having a lower concave surface 54, preferably having a radius A of about 2.4 inches, with the overall diameter B of the diffuser including a flange 55 being about 6 inches. The depth of the rear surface 52 is about 1.85 inches as shown as dimension C.

Referring to FIG. 12, there is shown a top view of the diffuser 50 including the flange 56 and a plurality of openings 58 in the flange 56 for facilitating the attachment of standoffs 52 to and between diffuser 50 and the heatsink 20, shown in FIG. 4.

Referring now to FIG. 13 there is shown the Fresnel lens 72, preferably having a diameter D of about 12.2 inches. However, limitation to this dimension is not to be inferred, but rather, is shown for purposes of the preferred embodiment of the present invention. The Fresnel lens 72 has a predetermined thickness, preferably in the range of about 1/16 inches. This lens is typically fabricated by being cut from a commercially available Fresnel lens.

Referring now back to FIG. 1A and FIG. 1B, there is shown generally at 56 a video camera oriented to view forward of the front face of solid state lamp 10 and 30, respectively. The view of this video camera 56 is precisionally aligned to view along and generally parallel to the central longitudinal axis shown at 58 that the beam of light generated by the internal LED array is oriented. Specifically, at large distances, such as greater than 20 feet, the video camera 56 generates an image having a center of the image generally aligned with the center of the light beam directed down the center axis 58. This allows the field technician to remotely electronically align the orientation of the light beam referencing this video image.

Figure 14A:
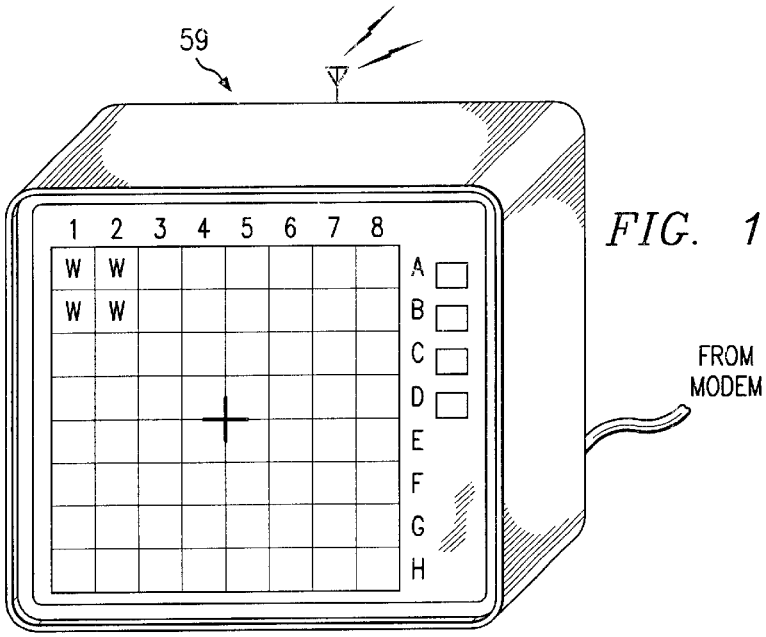
FIG. 14A is a view of a remote monitor displaying an image generated by a video camera in the light apparatus to facilitate electronic alignment of the LED light beam.

For instance, in one preferred embodiment the control electronics 60 has software generating and overlaying a grid along with the video image for display at a remote display terminal, such as a LCD or CRT display shown at 59 in FIG. 14A. This video image is transmitted electronically either by wire using a modem, or by wireless communication using a transmitter allowing the field technician on the ground to ascertain that portion of the road that is in the field of view of the generated light beam. By referencing this displayed image, the field technician can program which LEDs 42 should be electronically turned on, with the other LEDs 42 remaining off, such that the generated light beam will be focused by the associated optics including the Fresnel lens 72, to the proper lane of traffic. Thus, on the ground, the field technician can electronically direct the generated light beam from the LED arrays, by referencing the video image, to the proper location on the ground without mechanical adjustment at the light source, such as by an operator situated in a DOT bucket. For instance, if it is intended that the objects viewable and associated with the upper four windows defined by the grid should be illuminated, such as those objects viewable through the windows labeled as W in FIG. 14A, the LEDs 42 associated with the respective windows "W" will be turned on, with the rest of the LEDs 46 associated with the other windows being turned off. Preferably, there is one LED 46 associated with each window defined by the grid. Alternatively, a transparent sheet 73 having a grid 74 defining windows 78 can be laid over the display surface of the remote monitor 59 whereby each window 78 corresponds with one LED. For instance, there may be 64 windows associated with the 64 LEDs of the LED array. Individual control of the respective LEDs is discussed hereafter in reference to FIG. 14A. The video camera 56, such as a CCD camera or a CMCS camera, is physically aligned along the central axis 58, such that at extended distances the viewing area of the camera 56 is generally along the axis 58 and thus is optically aligned with regards to the normal axis 58 for purposes of optical alignment.

Figure 14B:
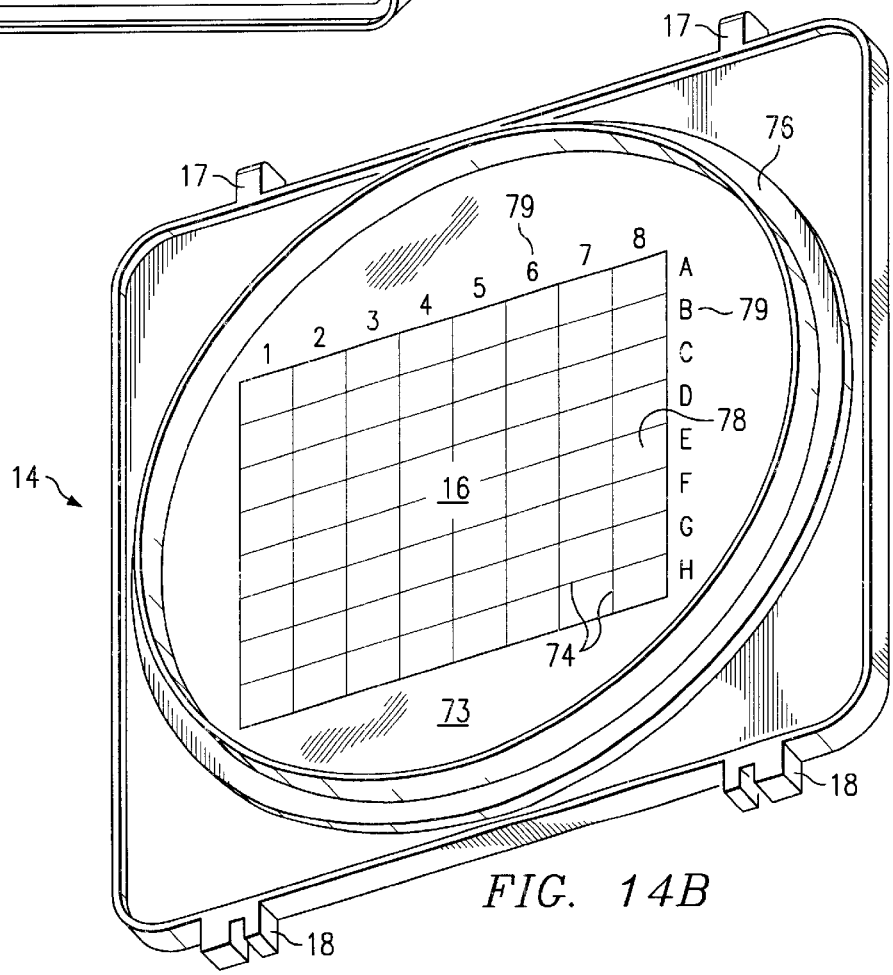
FIG. 14B is a perspective view of the lid of the apparatus shown in FIG. 1 having a grid overlay for use with the optical alignment system.

Referring now to FIG. 14B, there is illustrated the lid 14, the hinge members 17, and the respective latches 18. Holder 14 is seen to further have an annular flange member 70 defining a side wall about window 16, as shown. Further shown the transparent sheet 73 and grid 74 comprising of thin line markings defined over openings 16 defining windows 78. The sheet can be selectively placed over window 16 for alignment, and which is removable therefrom after alignment. Each window 78 is precisionally aligned with and corresponds to one sixty four (64) LEDs 42. Indicia 79 is provided to label the windows 78, with the column markings preferably being alphanumeric, and the columns being numeric. The windows 78 are visible through optical sight member 28, via an opening in heatsink 20. The objects viewed in each window 78 are illuminated substantially by the respective LED 42, allowing a technician to precisionally orient the apparatus 10 so that the desired LEDs 42 are oriented to direct light along a desired path and be viewed in a desired traffic lane. The sight member 28 may be provided with cross hairs to provide increased resolution in combination with the grid 74 for alignment.

Moreover, electronic circuitry 100 on daughterboard 60 can drive only selected LEDs 42 or selected 4×4 portions of array 40, such as a total of 16 LED's 42 being driven at any one time. Since different LED's have lenses 86 with different radius of curvature different thicknesses, or even comprised of different materials, the overall light beam can be electronically steered in about a 15° cone of light relative to a central axis defined by window 16 and normal to the array center axis.

For instance, driving the lower left 4×4 array of LEDs 42, with the other LEDs off, in combination with the diffuser 50 and lens 70 and 72, creates a light beam +7.5 degrees above a horizontal axis normal to the center of the 8×8 array of LEDs 42, and +7.5 degrees right of a vertical axis. Likewise, driving the upper right 4×4 array of LEDs 42 would create a light beam +10 degrees off the horizontal axis and +7.5 degrees to the right of a normalized vertical axis and −7.5 degrees below a vertical axis. The radius of curvature of the center lenses 86 may be, for instance, half that of the peripheral lenses 86. A beam steerable +/−7.5 degrees in 1–2 degree increments is selectable. This feature is particularly useful when masking the opening 16, such as to create a turn arrow. This further reduces ghosting or roll-off, which is stray light being directed in an unintended direction and viewable from an unintended traffic lane.

The electronically controlled LED array provides several technical advantages including no light is blocked, but rather is electronically steered to control a beam direction. Low power LEDs are used, whereby the small number of the LEDs "on" (i.e. 4 of 64) consume a total power about 1–2 watts, as opposed to an incandescent prior art bulb consuming 150 watts or a flood 15 watt LED which are masked or lowered. The present invention reduces power and heat generated thereby.

Figure 15:
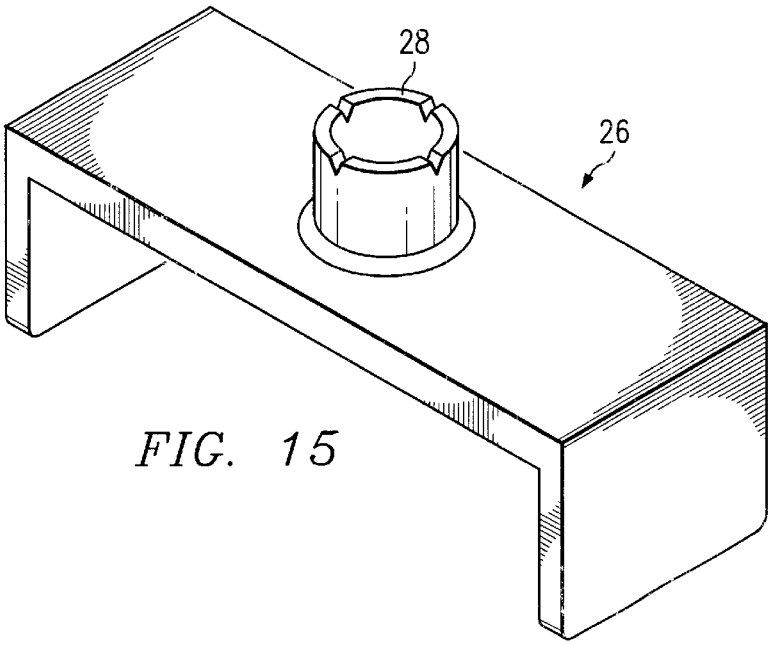
FIG. 15 is a perspective view of the optical alignment system eye piece adapted to connect to the rear of the light unit shown in FIG. 1.

Referring now to FIG. 15, there is shown a perspective view of the eye piece 26 as well as the optical sight member 28, as shown in FIG. 1. the center axis of optical sight member 28 is oriented along the center of the 8×8 LED array.

Referring now to FIG. 16, there is shown at 100 a schematic diagram of the circuitry controlling light apparatus 10. Circuit 10 is formed on the daughter board 60, and is electrically connected to the LED solid state light source 40, and selectively drives each of the individual LEDs 42 comprising the array. Depicted in FIG. 16 is a complex programmable logic device (CPLD) shown as U1. CPLD U1 is preferably an off-the-shelf component such as provided by Maxim Corporation, however, limitation to this specific part is not to be inferred. For instance, discrete logic could be provided in place of CPLD U1 to provide the functions as is described here, with it being understood that a CPLD is the preferred embodiment is of the present invention. CPLD U1 has a plurality of interface pins, and this embodiment, shown to have a total of 144 connection pins. Each of these pin are numbered and shown to be connected to the respective circuitry as will now be described.

Shown generally at 102 is a clock circuit providing a clock signal on line 104 to pin 125 of the CPLD U1. Preferably, this clock signal is a square wave provided at a frequency of 32.768 KHz. Clock circuit 102 is seen to include a crystal oscillator 106 coupled to an operational amplifier U5 and includes associated trim components including capacitors and resistors, and is seen to be connected to a first power supply having a voltage of about 3.3 volts.

Still referring to FIG. 16, there is shown at 110 a power up clear circuit comprised of an operational amplifier shown at U6 preferably having the non-inverting output coupled to pin 127 of CPLD U1. The inverting input is seen to be coupled between a pair of resistors providing a voltage divide circuit, providing approximately a 2.425 volt reference signal based on a power supply of 4.85 volts being provided to the positive rail of the voltage divide network. The inverting input is preferably coupled to the 4.85 voltage reference via a current limiting resistor, as shown.

As shown at 112, an operational amplifier U9 is shown to have its non-inverting output connected to pin 109 of CPLD U1. Operational amplifier U9 provides a power down function.

Referring now to circuit 120, there is shown a light intensity detection circuit detecting ambient light intensity and comprising of a photodiode identified as PD1. An operational amplifier depicted as U7 is seen to have its non-inverting input coupled to input pin 99 of CPLD U1. The non-inverting input of amplifier U7 is connected to the anode of photodiode PD1, which photodiode has its cathode connected via a capacitor to the second power supply having a voltage of about 4.85 volts. The non-inverting input of amplifier U7 is also connected via a diode Q1, depicted as a transistor with its emitter tied to its base and provided with a current limiting resistor. The inverting input of amplifier U7 is connected via a resistor to input 108 of CPLD U1.

Shown at 122 is a similar light detection circuit detecting the intensity of backscattered light from Fresnel lens 72 as shown at 124 in FIG. 3, and based around a second photodiode PD2, including an amplifier U10 and a diode Q2. The non-inverting output of amplifier U10, forming a buffer, is connected to pin 82 of CPLD U1.

An LED drive connector is shown at 130 serially interfaces LED drive signal data to drive circuitry of the LEDs 42. (Inventors please describe the additional drive circuit schematic).

Shown at 140 is another connector adapted to interface control signals from CPLD U1 to an initiation control circuit for the LED's.

Each of the LEDs 42 is individually controlled by CPLD U1 whereby the intensity of each LED 42 is controlled by the CPLD U1 selectively controlling a drive current thereto, a drive voltage, or adjusting a duty cycle of a pulse width modulation (PWM) drive signal, and as a function of sensed optical feedback signals derived from the photodiodes as will be described shortly here, in reference to FIG. 17.

Figure 17:
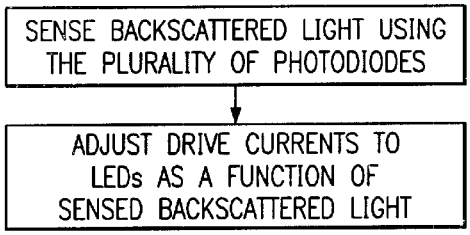
FIG. 17 is an algorithm depicting the sensing of ambient light and backscattered light to selectably provide a constant output of light.

Referring to FIG. 17 in view of FIG. 3, there is illustrated how light generated by solid state LED array 40 is diffused by diffuser 50, and a small portion 124 of which is backscattered by the inner surface of Fresnel lens 72 back toward the surface of daughter board 60. The back-scattered diffused light 124 is sensed by photodiodes PD2, shown in FIG. 16. The intensity of this back-scattered light 124 is measured by circuit 122 and provided to CPLD U1. CPLD U1 measures the intensity of the ambient light via circuit 120 using photodiode PD1. The light generated by LED's 42 is preferably distinguished by CPLD U1 by strobing the LEDs 42 using pulse width modulation (PWM) to discern ambient light (not pulsed) from the light generated by LEDs 42.

CPLD U1 individually controls the drive current, drive voltage, or PWM duty cycle to each of the respective LEDs 42 as a function of the light detected by circuits 120 and 122. For instance, it is expected that between 3 and 4% of the light generated by LED array 40 will back-scatter back from the fresnel lens 72 toward to the circuitry 100 disposed on daughter board 60 for detection. By normalizing the expected reflected light to be detected by photodiodes PD2 in circuit 122, for a given intensity of light to be emitted by LED array 40 through window 16 of lid 14, optical feedback is used to ensure an appropriate light output, and a constant light output from apparatus 10.

For instance, if the sensed back-scattered light, depicted as rays 124 in FIG. 3, is detected by photodiodes PD2 to fall about 2.5% from the normalized expected light to be sensed by photodiodes PD2, such as due to age of the LEDs 42, CPLD U1 responsively increases the drive current to the LEDs a predicted percentage, until the back-scattered light as detected by photodiodes PD2 is detected to be the normalized sensed light intensity. Thus, as the light output of LEDs 42 degrade over time, which is typical with LEDs, circuit 100 compensates for such degradation of light output, as well as for the failure of any individual LED to ensure that light generated by array 40 and transmitted through window 16 meets Department of Transportation (DOT) standards, such as a 44 point test. This optical feedback compensation technique is also advantageous to compensate for the temporary light output reduction when LEDs become heated, such as during day operation, known as the recoverable light, which recoverable light also varies over temperatures as well. Permanent light loss is over time of operation due to degradation of the chemical composition of the LED semiconductor material.

Preferably, each of the LEDs is driven by a pulse width modulated (PWM) drive signal, providing current during a predetermined portion of the duty cycle, such as for instance, 50%. As the LEDs age and decrease in light output intensity, and also during a day due to daily temperature variations, the duty cycle may be responsively, slowly and continuously increased or adjusted such that the duty cycle is appropriate until the intensity of detected light by photodiodes PD2 is detected to be the normalized detected light. When the light sensed by photodides PD2 are determined by controller 60 to fall below a predetermined threshold indicative of the overall light output being below DOT standards, a notification signal is generated by the CPLD U1 which may be electronically generated and transmitted by an RF modem, for instance, to a remote operator allowing the dispatch of service personnel to service the light. Alternatively, the apparatus 10 can responsively be shut down entirely.

Figure 18B:
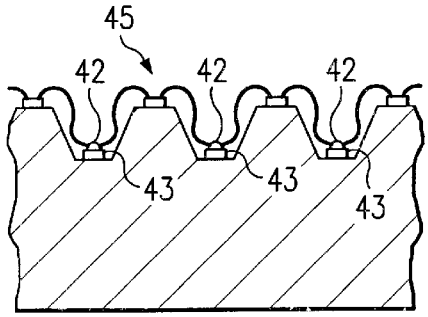
FIG. 18*a* AND FIG. 18B are side sectional views of an alternative preferred embodiment including a heatsink with recesses, with the LED's wired in parallel and series, respectively.
Figure 18A:
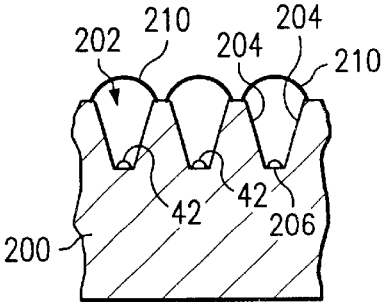

Referring now to FIG. 18A and FIG. 18B, there is shown an alternative preferred embodiment of the present invention including a heatsink 200 machined or stamped to have an array of reflectors 202. Each recess 202 is defined by outwardly tapered sidewalls 204 and a base surface 208, each recess 202 having mounted thereon a respective LED 42. A lens array having a separate lens 210 for each LED 42 is secured to the heatsink 200 over each recess 202, eliminating the need for a lens holder. The tapered sidewalls 206 serve as light reflectors to direct generated light through the respective lens 210 at an appropriate angle to direct the associated light to the diffuser 50 having the same surface area of illumination for each LED 42. In one embodiment, as shown in FIG. 18A, LEDs 42 are electrically connected in parallel. The cathode of each LED 42 is electrically coupled to the electrically conductive heatsink 200, with a respective lead 212 from the anode being coupled to drive circuitry 216 disposed as a thin film PCB 45 adhered to the surface of the heatsink 200, or defined on the daughterboard 60 as desired. Alternatively, as shown in FIG. 18B, each of the LED's may be electrically connected in series, such as in groups of three, and disposed on an electrically non-conductive thermally conductive material 43 such as ceramic, diamond, SiN or other suitable materials. In a further embodiment, the electrically non-conductive thermally conductive material may be formed in a single process by using a semiconductor process, such as diffusing a thin layer of material in a vacuum chamber, such as 8000 Angstroms of SiN, which a further step of defining electrically conductive circuit traces 45 on this thin layer.

Figure 19:
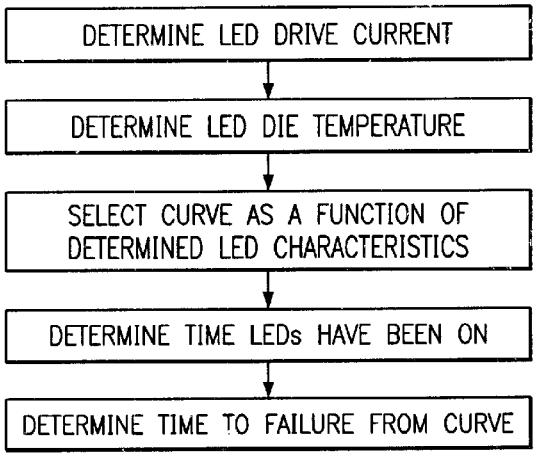
FIG. 19 is an algorithm depicting generating information indicative of the light operation, function and prediction of when the said state apparatus will fail or provide output below acceptable light output.
Figure 16A:
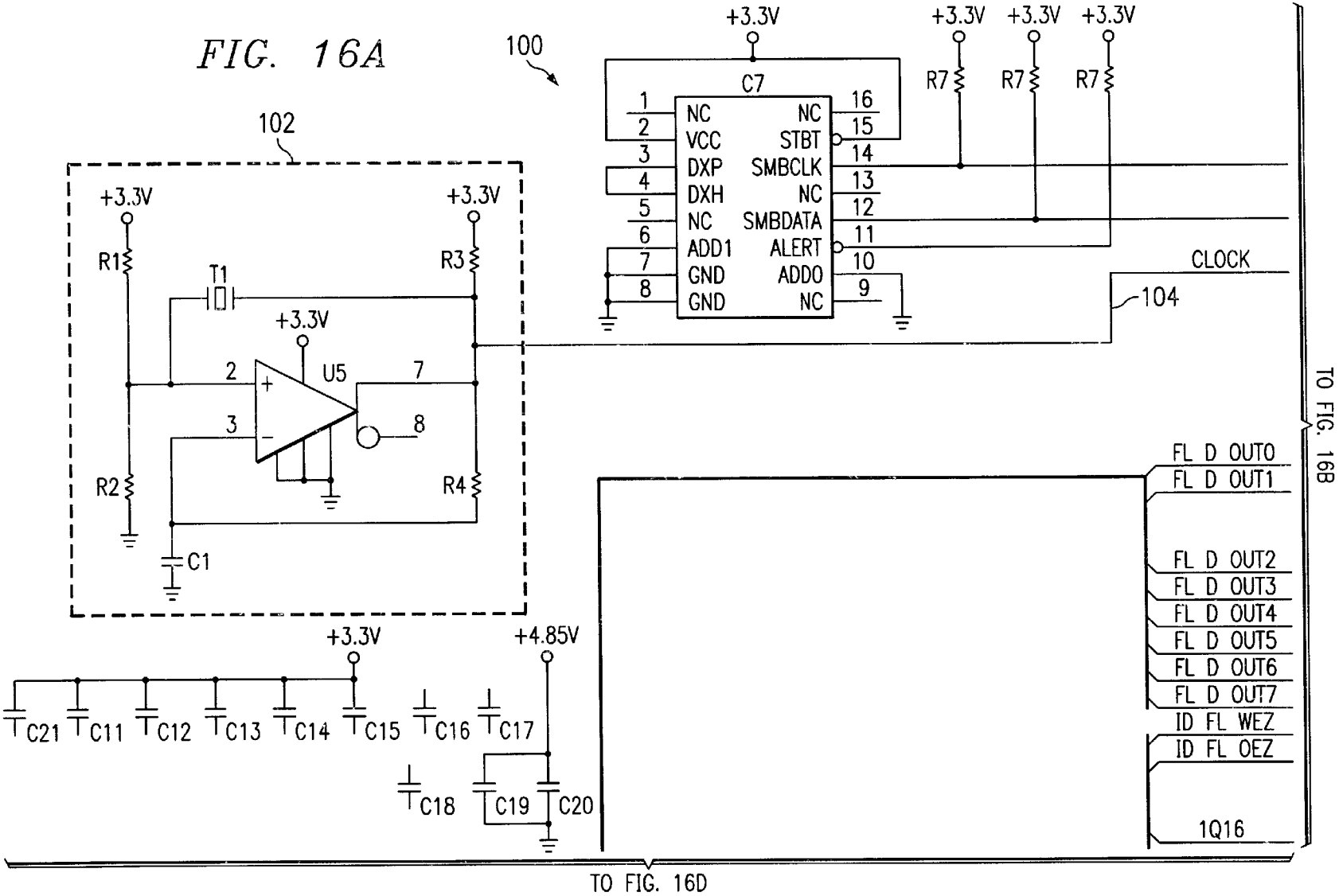
FIG. 16 is a schematic diagram of the control circuitry disposed on the daughterboard and incorporating various features of the invention including control logic, as well as light detectors for sensing ambient light and reflected generated light from the light diffuser used to determine and control the light output from the solid state light.
Figure 16B:
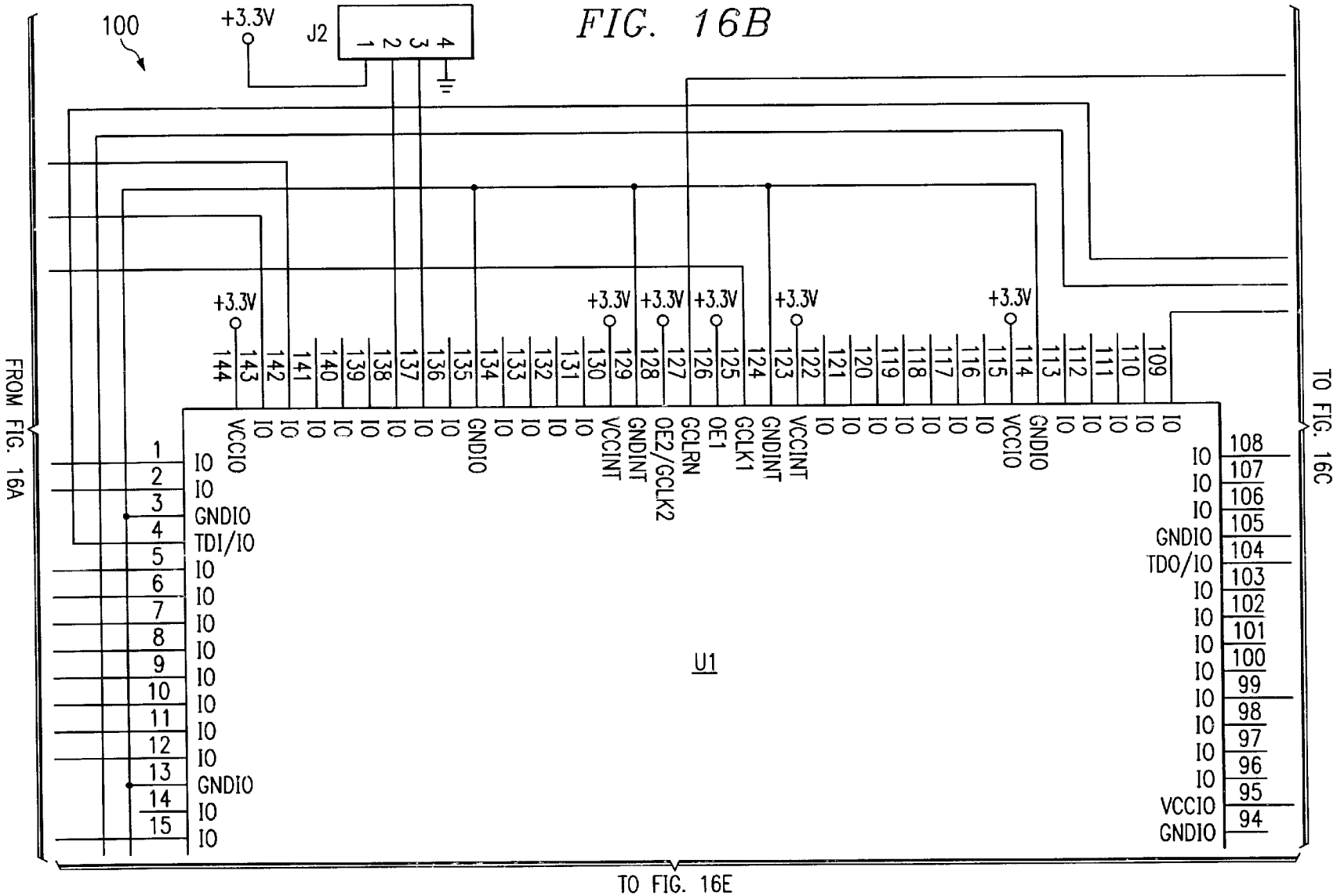
Figure 16C:
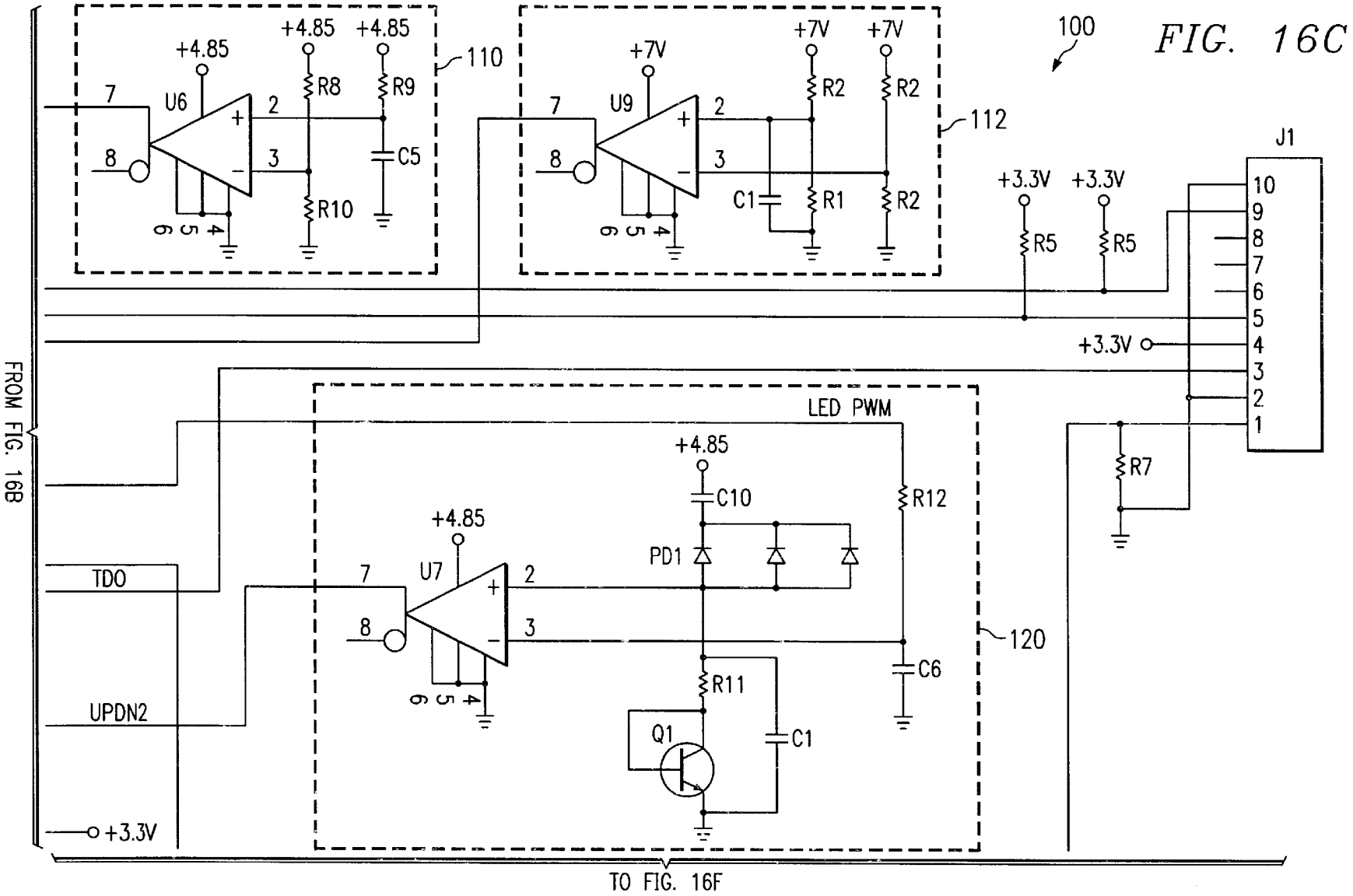
Figure 16D:
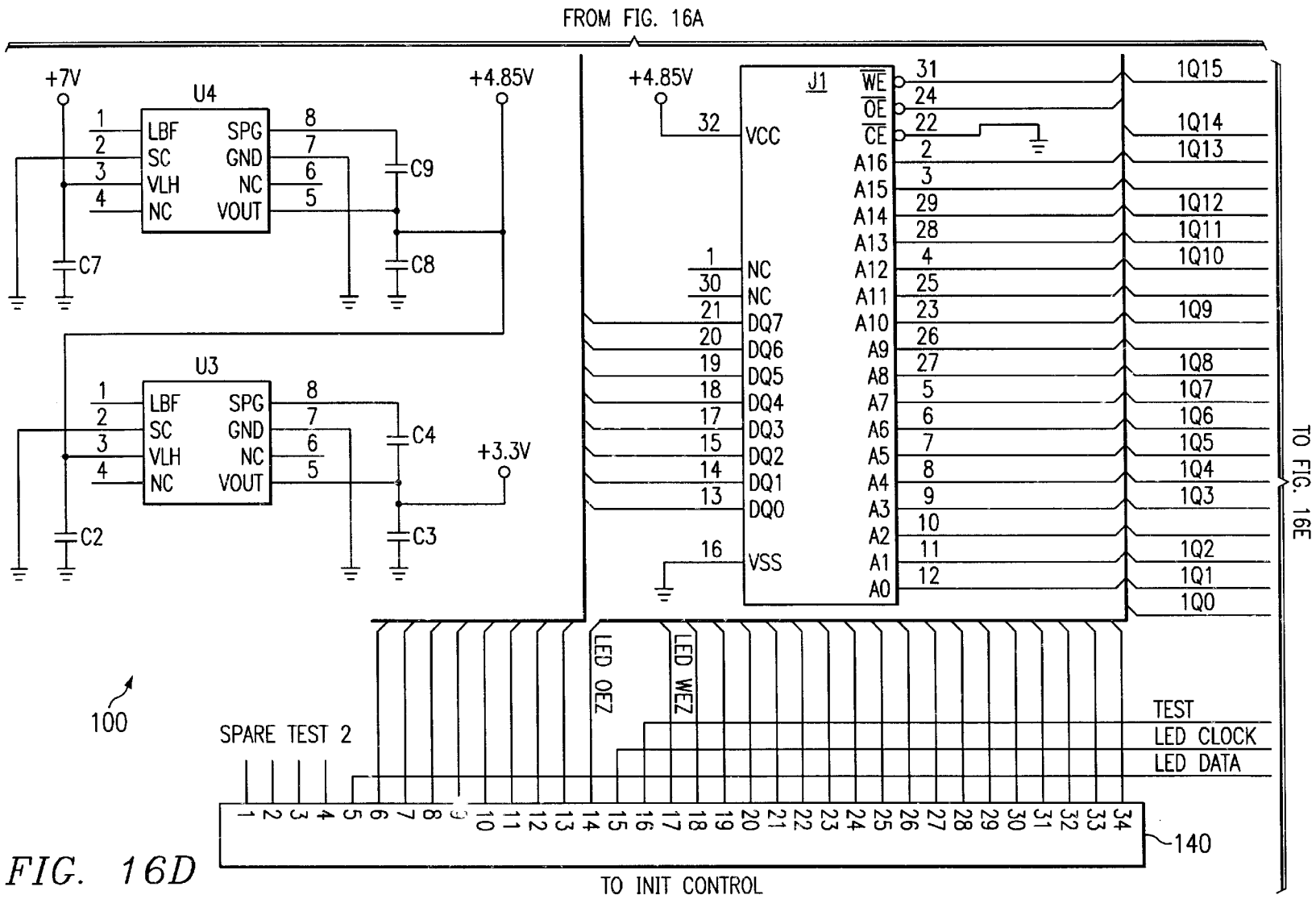
Figure 16E:
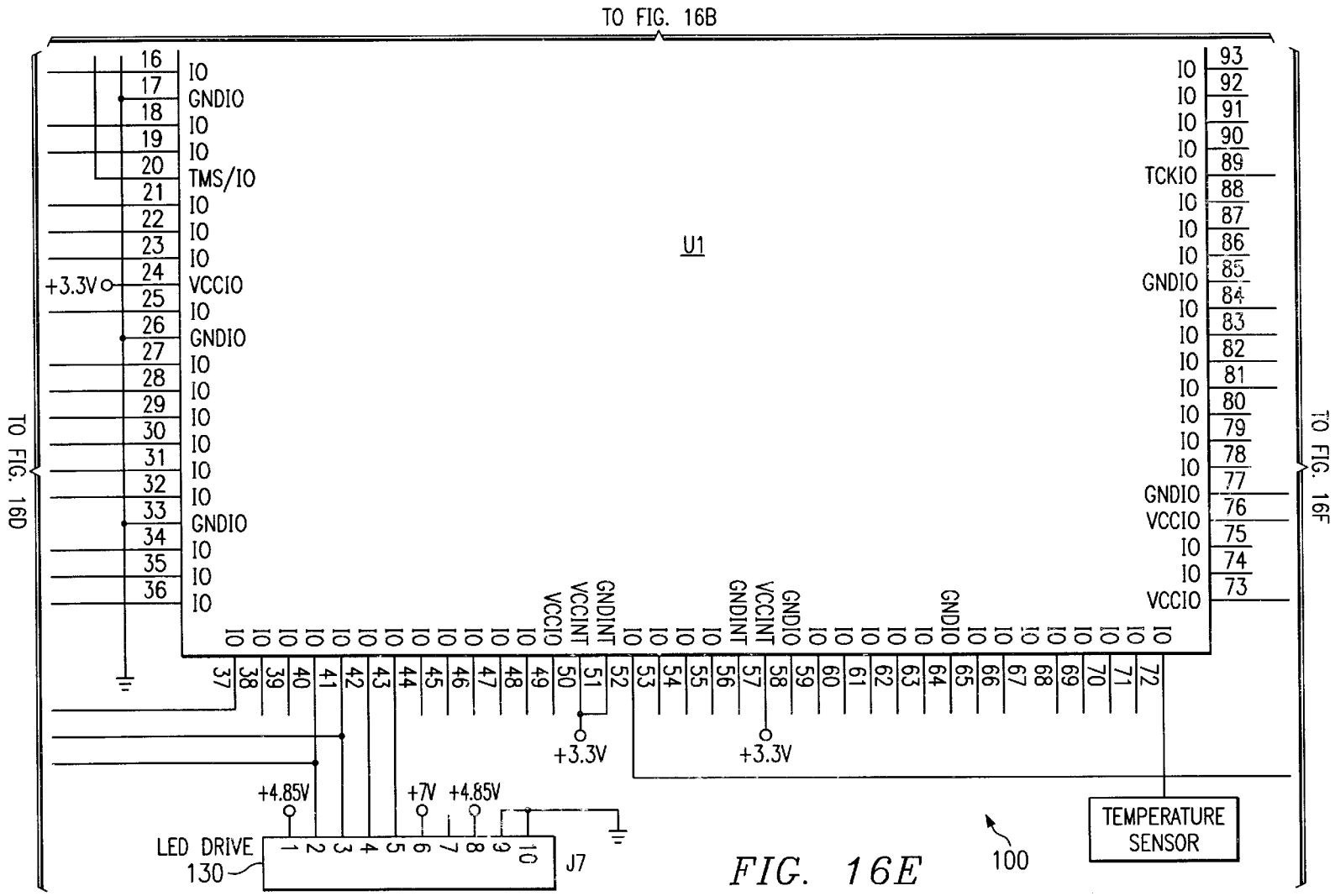
Figure 16F:
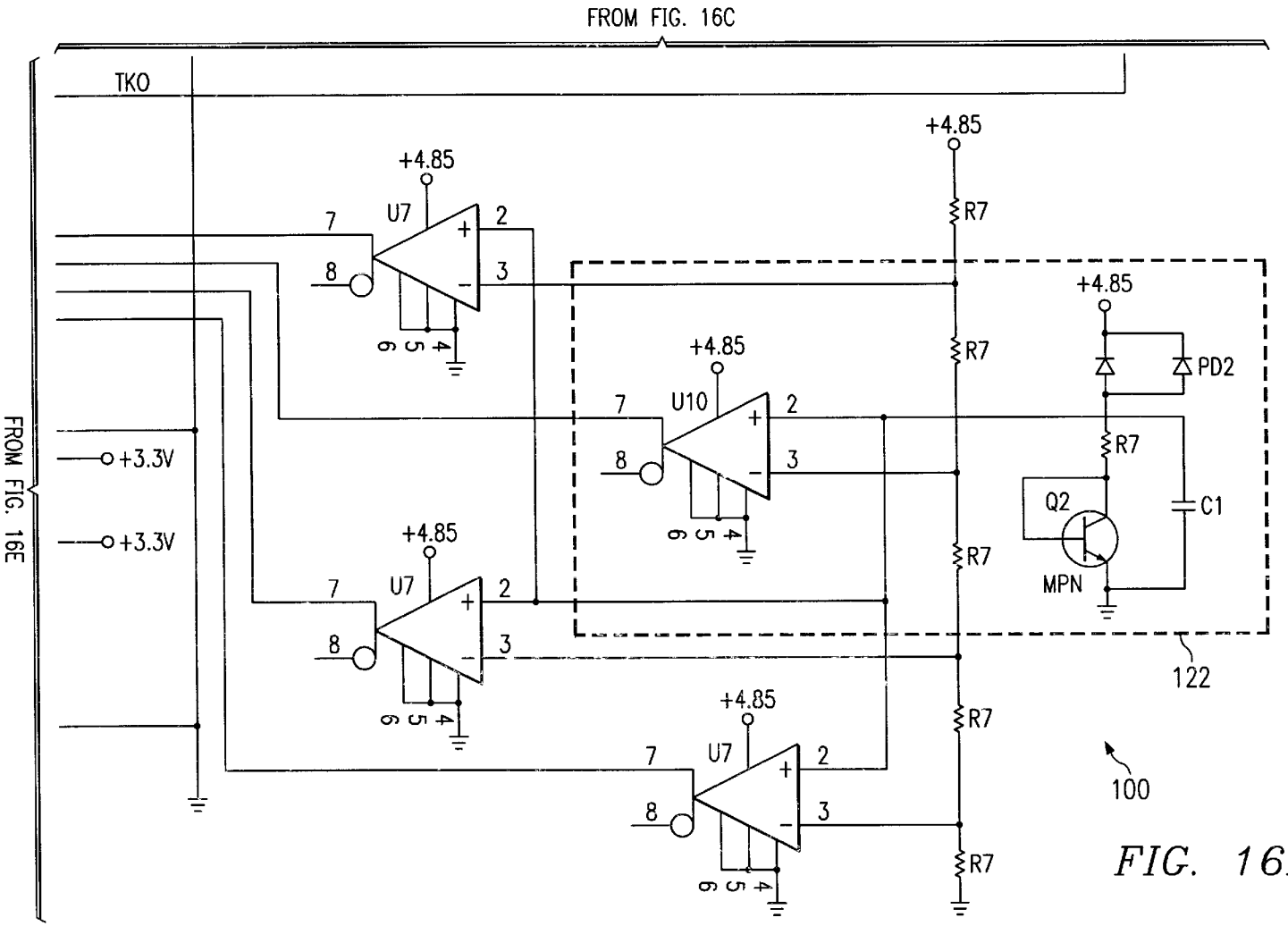
Figure 20:
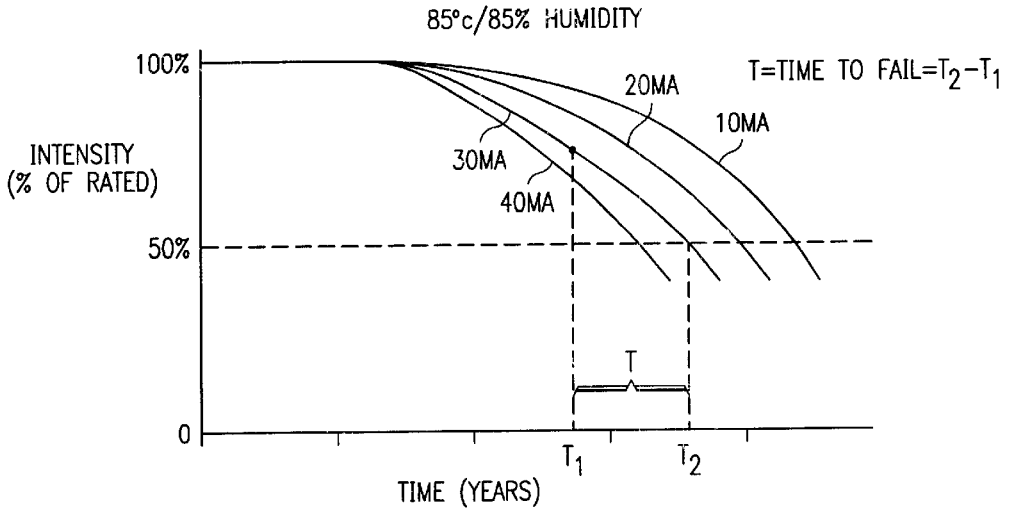
FIGS. 20 and 21 illustrate operating characteristics of the LEDs as a function of PWM duty cycles and temperature as a function of generated output light.
Figure 21:
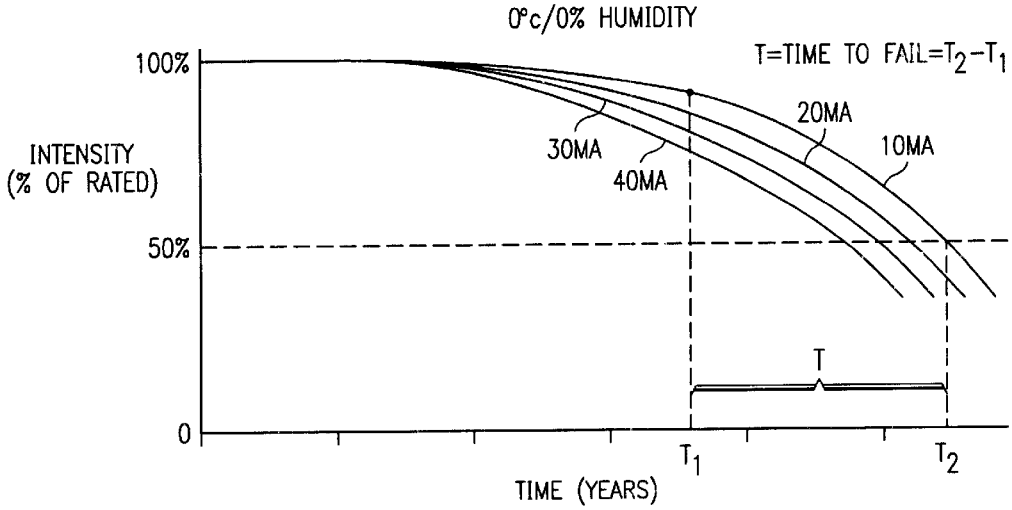

FIG. 19 shows an algorithm controller 60 applies for predicting when the solid state light apparatus will fail, and when the solid state light apparatus will produce a beam of light having an intensity below a predetermined minimum intensity such as that established by the DOT. Referring to the graphs in FIG. 20 and 21, the known operating characteristics of the particular LEDs produced by the LED manufacture are illustrated and stored in memory, allowing the controller 60 to predict when the LED is about the fail. Knowing the LED drive current operating temperature, and total time the LED as been on, the controller 60 determines which operating curve in FIG. 20 and FIG. 21 applies to the current operating conditions, and determines the time until the LED will degrade to a performance level below spec, i.e. below DOT minimum intensity requirements.

Figure 22:
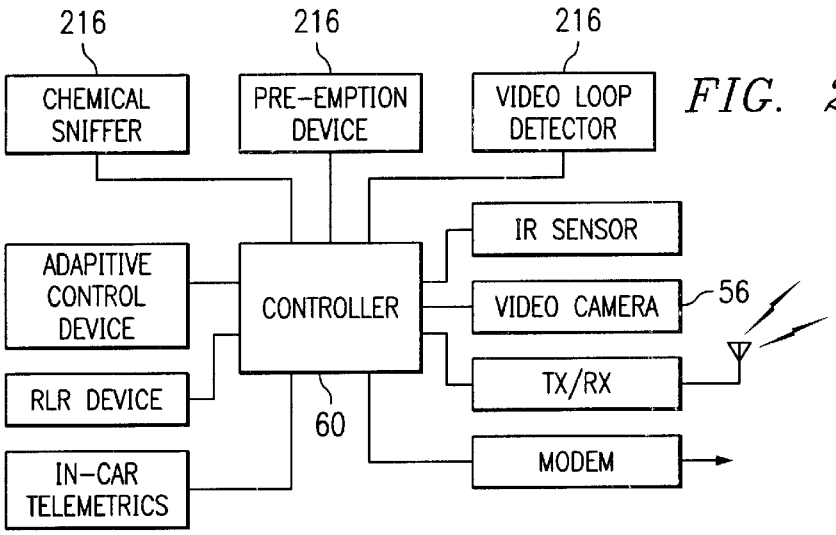
FIG. 22 is a block diagram of a modular light apparatus having selectively interchangeable devices that are field replaceable.

FIG. 22 depicts a block diagram of the modular solid state traffic light device. The modular field-replaceable devices are each adapted to selectively interface with the control logic daughterboard 60 via a suitable mating connector set. Each of these modular field replaceable devices 216 are preferably embodied as a separate card, with possibly one or more feature on a single field replacable card, adapted to attach to daughterboard 60 by sliding into or bolting to the daughterboard 60. The devices can be selected from, alone or in combination with, a pre-emption device, a chemical sniffer, a video loop detector, an adaptive control device, a red light running (RLR) device, and an in-car telematic device, infrared sensors to sense people and vehicles under fog, rain, smoke and other adverse visual conditions, automobile emission monitoring, various communication links, electronically steerable beam, exhaust emission violations detection, power supply predictive failure analysis, or other suitable traffic devices.

The solid state light apparatus 10 of the present invention has numerous technical advantages, including the ability to sink heat generated from the LED array to thereby reduce the operating temperature of the LEDs and increase the useful life thereof. Moreover, the control circuitry driving the LEDs includes optical feedback for detecting a portion of the back-scattered light from the LED array, as well as the intensity of the ambient light, facilitating controlling the individual drive currents, drive voltages, or increasing the duty cycles of the drive voltage, such that the overall light intensity emitted by the LED array 40 is constant, and meets DOT requirements. The apparatus is modular in that individual sections can be replaced at a modular level as upgrades become available, and to facilitate easy repair. With regards to circuitry 100, CPLD U1 is securable within a respective socket, and can be replaced or reprogrammed as improvements to the logic become available. Other advantages include programming CPLD U1 such that each of the LEDs 42 comprising array 40 can have different drive currents or drive voltages to provide an overall beam of light having beam characteristics with predetermined and preferably parameters. For instance, the beam can be selectively directed into two directions by driving only portions of the LED array in combination with lens 70 and 72. One portion of the beam may be selected to be more intense than other portions of the beam, and selectively directed off axis from a central axis of the LED array 40 using the optics and the electronic beam steering driving arrangement.

Figure 24:
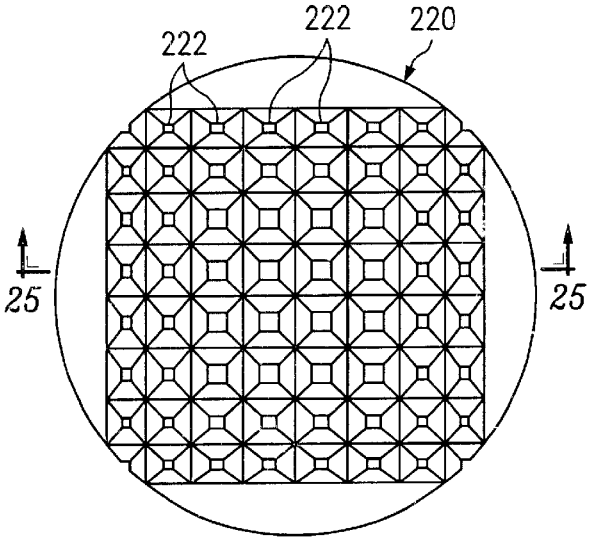
FIG. 24 shows a top view of FIG. 23 of the light guide for use with the diffuser.
Figure 23:
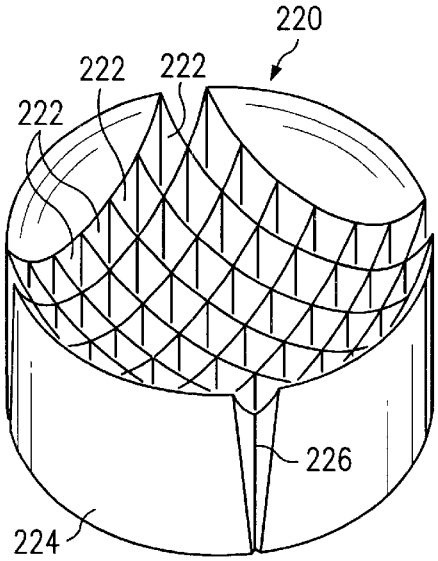
FIG. 23 is a perspective view of a light guide having a light channel for each LED to direct the respective LED light to the diffuser.
Figure 25:
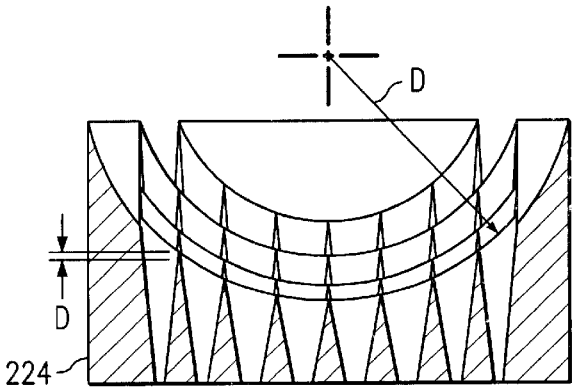
FIG. 25 shows a side sectional view taken along line 24—24 in FIG. 3 illustrating a separate light guide cavity for each LED extending to the light diffuser.

Referring now to FIG. 23, there is shown at 220 a light guide device having a concave upper surface and a plurality of vertical light guides shown at 222. One light guide 222 is provided for and positioned over each LED 42, which light guide 222 upwardly directs the light generated by the respective LED 42 to impinge the outer surface of the diffuser 54. The guides 222 taper outwardly at a top end thereof, as shown in FIG. 24 and FIG. 25, such that the area at the top of each light guide 222 is identical. Thus each LED 42 illuminates an equal surface area of the light diffuser 54, thereby providing a uniform intensity light beam from light diffuser 54. A thin membrane 224 defines the light guide, like a honeycomb, and tapers outwardly to a point edge at the top of the device 220. These point edges are separated by a small vertical distance D shown in FIG. 25, such as 1 mm, from the above diffuser 54 to ensure uniform lighting at the transistion edges of the light guides 222 while preventing bleeding of light laterally between guides, and to prevent light roll-off by generating a homogeneous beam of light. Vertical recesses 226 permit standoffs 52 extending along the sides of device 220 (see FIG. 3) to support the peripheral edge of the diffuser 54.

While the invention has been described in conjunction with preferred embodiments, it should be understood that modifications will become apparent to those of ordinary skill in the art and that such modifications are therein to be included within the scope of the invention and the following claims.

I claim:

1. A control light comprising:

a housing;

a solid state light source comprising an array of LED's coupled to said housing and adapted to generate a light beam; and an alignment device comprising a video camera optically coupled to said light source providing an image indicating an orientation of said light beam, said image including a grid defining a plurality of windows, each said window being associated with at least one LED in said array.

2. The control light of claim 1 wherein each said window is indicative of a viewing angle of said respective LED.

3. The control light of claim 2 further comprising control electronics adapted to individually selectively control the intensity of each said LED.

4. The control light of claim 3 wherein said control electronics individually controls which said LEDs are on and off.

5. The control light of claim 4 wherein said windows are labeled with indicia identifying said respective LED associated with each said window.

6. A method of aligning a traffic control light, comprising:

a housing;

an array of LEDs coupled to said housing and adapted to generate a light beam; and an optical alignment device optically coupled to said LED array providing an indication of the orientating said light beam is oriented, wherein said optical alignment device generates markings comprising a grid defining windows, each window aligned with respect to a respective LED in said array, wherein each said window is associated with one of the LEDs;

comprising steps of:

orienting a direction of said light beam by using said optical alignment device, further comprising the step of associating objects with said windows to determine which objects are illuminated by said LEDs.

7. The method as specified in claim 6 wherein said optical alignment device comprises a video camera coupled to said housing, comprising the stop of viewing a video image generated by said video camera to orient a direction of said generated light beam.

8. A control light, comprising:

a housing;

a solid state light source coupled to said housing and adapted to generate a light beam;

an alignment device comprising an optical sighting apparatus optically coupled to said light source providing an Indication of the orientation said light beam; and a transparent member disposed to pass said light beam, said transparent member having markings operative with said optical sighting apparatus to facilitate indicating the orientation said light beam is directed.

9. The control light of claim 8 wherein said markings comprise a grid.

10. The control light of claim 9 wherein said optical sighting apparatus comprises cross hairs.

11. The control light of claim 9 wherein said markings comprise a grid defining windows, each window oriented with respect to one said LED, wherein each said window is visible through said optical sighting apparatus.

12. The control light of claim 11 wherein objects viewable through said optical sighting apparatus and said respective window are illuminated by light generated by said LED associated with said respective window.

13. The control light of claim 12 wherein objects not viewable through said respective window are not substantially illuminated by light generated by said LED associated with said window.

14. The control light of claim 11 wherein said windows are identified with a column marking and a row marking.

15. The control light of claim 14 wherein said row marking is alphanumeric.

16. The control light of claim 15 wherein said column marking is numeric.

17. A control light, comprising:

a solid state light source comprised of an LED array adapted to generate a light beam;

a video camera generating an image associated with an orientation of said light beam; and a control adapted to turn selected said LEDs on and off as a function of the video image to steer the light beam.

18. The control light of claim 17 wherein the control selectively electronically steers the light beam as a function of the displayed image.

19. The control light of claim 17 wherein said video image directly corresponds to which objects can be illuminated by the light beam.

20. The control light of claim 17 further comprising means for displaying markings in association with said video image, said control being adapted to control said LEDs as a function of said markings.

* * * * *